US008448594B2

(12) United States Patent
Dukes

(10) Patent No.: US 8,448,594 B2
(45) Date of Patent: May 28, 2013

(54) VEHICLE HEIGHT RESTRICTOR AND ALERTING DEVICE

(76) Inventor: David Allen Dukes, Gay, GA (US)

( * ) Notice: Subject to any disclaimer, the term of this patent is extended or adjusted under 35 U.S.C. 154(b) by 17 days.

(21) Appl. No.: 12/460,098

(22) Filed: Jul. 14, 2009

(65) Prior Publication Data

US 2010/0064963 A1 Mar. 18, 2010

Related U.S. Application Data

(60) Provisional application No. 61/192,290, filed on Sep. 17, 2008.

(51) Int. Cl.
*E01F 13/00* (2006.01)
*E01F 9/00* (2006.01)

(52) U.S. Cl.
USPC ..... 116/63 R; 248/900

(58) Field of Classification Search
USPC ..... 116/28 R, 63 R; 40/606.01, 606.14, 40/606.15, 606.17, 607.01, 607.05, 607.06, 40/607.09, 607.1, 607.11, 607.04; 248/346.01, 248/519, 523, 530, 548, 900, 130, 131, 133, 248/145; 232/39
See application file for complete search history.

(56) References Cited

U.S. PATENT DOCUMENTS

| | | | | | |
|---|---|---|---|---|---|
| 1,273,696 | A | * | 7/1918 | Vanhoof | 248/145 |
| 1,645,768 | A | * | 10/1927 | Morten, Jr. | 248/145 |
| 2,050,280 | A | * | 8/1936 | Dean | 248/145 |
| 2,409,076 | A | * | 10/1946 | Steinberger et al. | 40/606.15 |
| 2,683,013 | A | * | 7/1954 | Amundson et al. | 248/145 |
| 2,936,143 | A | * | 5/1960 | Anderson | 248/145 |
| 3,085,546 | A | * | 4/1963 | Pelletier | 116/63 R |
| RE26,779 | E | * | 2/1970 | Weichenrieder | 116/63 R |
| 3,716,833 | A | | 2/1973 | Roth | |
| 4,284,971 | A | | 8/1981 | Lowry et al. | |
| 4,808,997 | A | | 2/1989 | Barkley et al. | |
| 4,916,429 | A | | 4/1990 | Hicks et al. | |
| 5,390,719 | A | | 2/1995 | Barnes | |
| 5,828,320 | A | | 10/1998 | Buck | |
| 5,904,115 | A | * | 5/1999 | Durbin et al. | 116/28 R |
| 6,172,604 | B1 | | 1/2001 | Heillman et al. | |
| 6,202,369 | B1 | * | 3/2001 | Partee et al. | 52/165 |
| 6,591,556 | B2 | | 7/2003 | Bertheaume et al. | |
| 6,625,912 | B2 | * | 9/2003 | Dicke et al. | 40/610 |
| 7,163,142 | B2 | * | 1/2007 | DeLine et al. | 232/39 |
| 7,259,660 | B2 | | 8/2007 | Ewerhart et al. | |
| 7,353,985 | B1 | * | 4/2008 | Weatherholt, II | 232/39 |
| 7,980,533 | B1 | * | 7/2011 | Anderson et al. | 256/13.1 |
| 2008/0078112 | A1 | * | 4/2008 | Basha | 40/606.15 |
| 2012/0192469 | A1 | * | 8/2012 | Kagen et al. | 40/607.04 |

* cited by examiner

*Primary Examiner* — R. A. Smith
(74) *Attorney, Agent, or Firm* — J. T. Hollin, Jr.

(57) ABSTRACT

Disclosed is a device for providing a preliminary alert to the driver of a vehicle approaching an overhead obstacle. The inventive concept consists of a vertical mounting post to which is attached a non-marring horizontal height restrictor arm. The position of the height restrictor arm on the vertical post is at the same vertical distance from the roadway surface as is the vertical distance of the specific overhead obstacle for which an alert is provided. The height restrictor arm is affixed to the vertical post by means of a multi-directional pivotal connector comprising a hollow sphere, spring, and chain assembly. The pivotal connector allows the height restrictor arm to move, after contact by a vehicle, in a multitude of directions, fore and aft, up or down.

5 Claims, 3 Drawing Sheets

VEHICLE HEIGHT RESTRICTOR AND ALERTING DEVICE

CROSS-REFERENCES TO RELATED APPLICATION

This application claims priority to, and the benefit of, U.S. Provisional Patent Application No. 61/192,290 filed on Sep. 17, 2008 and said application is incorporated herein by reference.

STATEMENT REGARDING FEDERALLY SPONSORED RESEARCH OR DEVELOPMENT

There is no federally sponsored research or development in conjunction with this application.

NAMES OF THE PARTIES TO A JOINT RESEARCH AGREEMENT

There has been no joint research performed with respect to this application.

REFERENCE TO A "SEQUENCE LISTING," A TABLE, OR A COMPUTER PROGRAM LISTING APPENDIX

Not applicable.

BACKGROUND OF THE INVENTION (1) Field of the Invention

Around the world there are found many areas where cars and trucks operate off the main traveled roadways and approach parking areas, tunnels, or drive-through commercial establishments. In such areas drivers frequently encounter height restraint barriers as a precursor to warn of an upcoming obstacle such as the overhang of the canopy of a cashier's station, a structural beam of a multi-level parking lot, or other such obstruction.

It is quite common to see brightly painted or reflective horizontal, pivotal, flexible, and/or cushioned arms which have been mounted on supports or suspended from the obstruction itself to provide an alert. The present invention introduces a unique concept to visually and physically alert the driver that an overhead collision is imminent. The alert serves both to protect the canopy or overhead barrier from damage and further, to minimize the possibility of damage to the roof of a vehicle or the cargo secured to the top of a vehicle. The device is positioned in an area just prior to the obstacle so as to provide a warning to the driver upon entering the vicinity of the barrier or obstacle.

(2) Description of the Related Art

Some of the earliest mechanisms used to provide early warning to drivers approaching overhead barriers were electronic, or emitted non-visual alerts. In U.S. Pat. No. 3,716,833 (Roth, 1973) two pairs of coordinated optical signal devices are mounted on the higher parts of a truck. The pairs of optical radiators modulate at the same frequency and a change in the phase angles of the signals identifies that the relative height of an approaching overhead passageway is too low in comparison with the upper area of the truck. An alarm is then generated within the truck cab.

In an operation converse to the previous patent, U.S. Pat. No. 4,284,971 (Lowry, 1981) successive matching pairs of light emitters and light sensors are positioned along both sides of a roadway in advance of the overhead structure.

Should a vehicle, with a height exceeding that of the structure, approach the structure while traveling on the roadway, the light beams are broken in sequence, the frequency of the beam interruption being governed by the speed of the vehicle. Thereupon, a visible, flashing electronic sign renders a warning to the driver to stop or exit from the roadway.

In 1990, U.S. Pat. No. 4,916,429 was issued to E. Hicks wherein a detector system was designed to operate in the area at the approach to an overhanging roof or canopy at a drive-through restaurant. The system employs a photoelectric switch which detects an over-height vehicle and immediately sends an audible and/or visual signal to the driver as he/she approaches the drive-through order window.

A canopy assembly constructed with an over-height impact bar on its front frame is featured in U.S. Pat. No. 5,390,719 (Barnes, 1995). In the event a high-rise vehicle makes contact with the impact bar, an alarm is emitted and the impact bar moves slightly backwards. Should the driver not stop the vehicle at this point, more contact pressure from the vehicle triggers the impact bar to send a release signal to a latch integral to the canopy mounting post. As the latch releases, the entire canopy swivels about the mounting post and clear of the path of the oncoming vehicle.

U.S. Pat. No. 6,591,556 (Bertheaume, 2002) discloses a canopy assembly mounted on a column, which column contains a pivotal coupler. When the leading edge of the canopy is struck by a vehicle, the pivotal coupler is immediately rotated, causing the roof of the canopy to rotate counter clockwise, as viewed from above. The canopy also elevates slightly and once the vehicle is clear of the column, the pivotal coupler allows the canopy to rotate in the opposite direction back to its normal position.

BRIEF SUMMARY OF THE INVENTION

This inventive concept presents a device for giving advance warning to a driver whose vehicle is approaching an overhead obstacle or barrier. The device is particularly useful at establishments such as drive through fast food restaurants, ATM machines and cashiers' windows located at bank facilities, or multi-level parking decks. Essentially, the invention features a vertical mounting post onto which is attached a universally pivotable horizontal head assembly. The head assembly houses an elongated spring mechanism. The pivotal end of the spring mechanism is anchored inside a hollow metal sphere. Should a vehicle contact the head assembly, the spring mechanism and the hollow sphere permit the entire head assembly to pivot vertically, horizontally, diagonally, or in any combination of these positions. Such movement or rotation alerts the driver that there is an imminent lack of clearance between the top of his vehicle and the upcoming obstacle. In conjunction with installment of the device at a desired locale, bolts on the device allow the height of the head assembly to be raised or lowered in conjunction with the height of the overhanging obstacle for which an alert is to be rendered.

BRIEF DESCRIPTION OF THE VIEWS OF THE DRAWINGS

FIG. 2(*a*) presents the embedded mounting base.

FIG. 7(*a*) is a lateral cross-sectional view of the housing for the head assembly.

INDEX TO COMPONENTS OF INVENTION

| Index to Components of Invention | |
|---|---|
| 1. | Short base post |
| 2. | Drilled base plate |
| 3. | Base attachment holes |
| 4. | Bolted mounting base |
| 5. | Embedded mounting base |
| 6. | Main post |
| 7. | Collar |
| 8. | Collar hole |
| 9. | Collar bolt |
| 10. | Head assembly |
| 11. | Passing link chain |
| 12., 12(a) | S-Hook |
| 13. | Extension spring |
| 14. | Threaded rod |
| 15. | Head connector |
| 16. | Head connector nut |
| 17. | Head connector bolt |
| 18. | Head assembly housing |
| 19. | Reducer bushing |
| 20. | Housing end cap |
| 21. | Retaining nut |
| 22. | Hollow sphere |
| 23. | Weld |
| 24. | Circular opening |
| 25. | Hole for connector |
| 26. | Main post cap |
| 27. | Base bolt |
| 28. | Height restrictor |
| 29. | Restrictor arm |

DETAILED DESCRIPTION OF THE INVENTION

Figure 1:
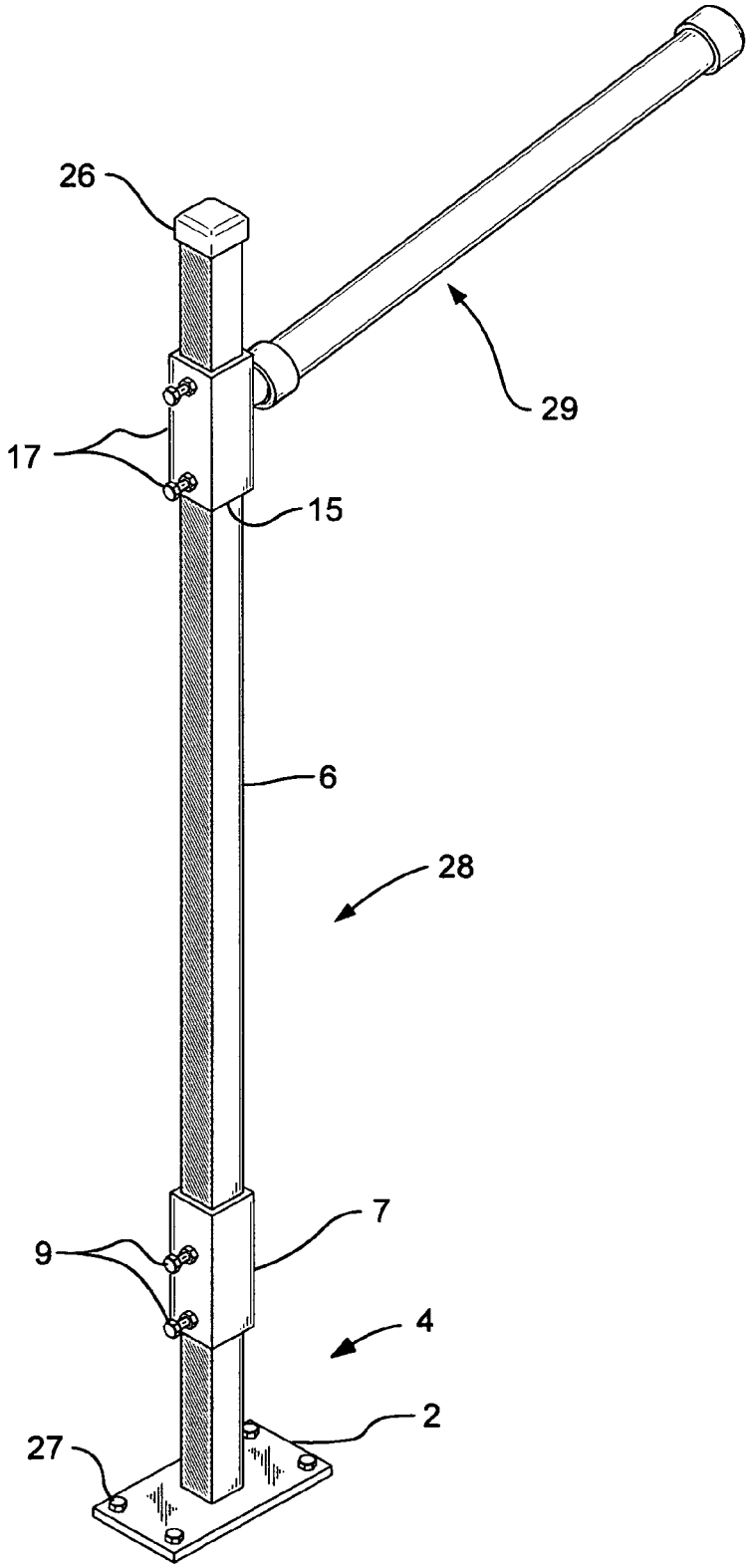
FIG. 1 is a view of the completely assembled invention, utilizing a bolted mounting base attached to a concrete foundation.

In viewing FIG. 1, the complete structure of the height restrictor 28 concept is displayed. The main components are seen to be a bolted mounting base 4, a mounting post 6, a head connector 15, and a restrictor arm 29. In analyzing the manner in which the components coordinate with each other, FIG. 1 will be visualized part by part, assuming a process of initial construction.

Figure 2:
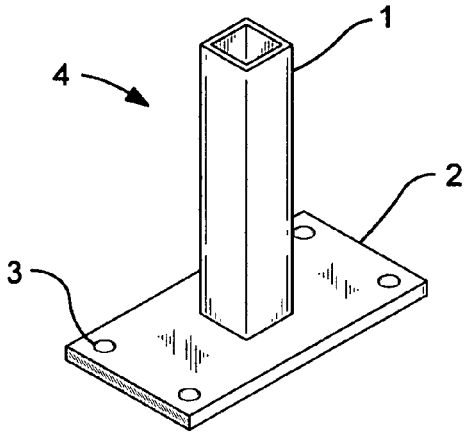
FIG. 2 is an isolated view of the bolted mounting base.

We begin the description of the components of the invention with the bolted mounting base 4, as more clearly shown in FIG. 2. One of the features of this mounting base 4 is a drilled base plate 2, containing four base attachment holes 3. The drilled base plate 2 is designed to be attached, by means of base bolts 27, to a concrete, wood, or other foundation as shown in FIG. 1. If conditions warrant, an embedded mounting base 5, as shown in FIG. 2(*a*), may be utilized by directly inserting the embedded mounting base 5 into a concrete foundation.

Figure 4:
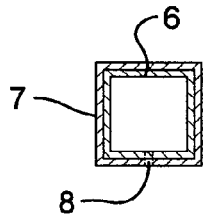
FIG. 4 presents a cross-sectional plan view of the main post.
Figure 2A:
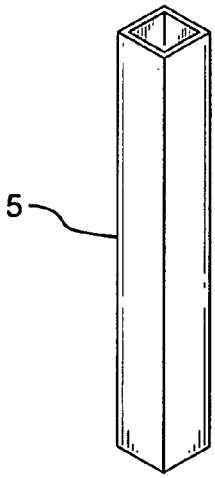
Figure 3:
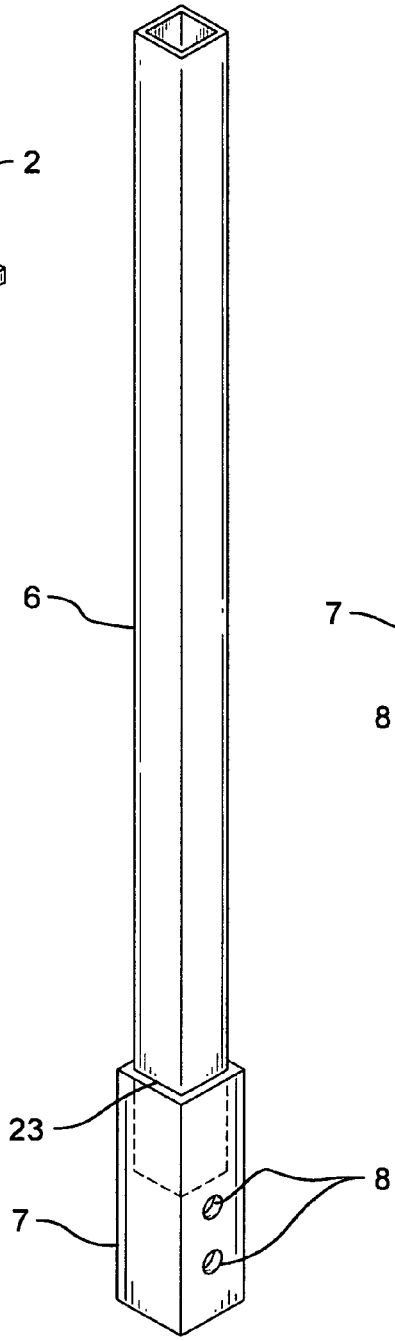
FIG. 3 is a view of the main post, including its collar as affixed to the bottom of the post.

Placed directly atop either the bolted mounting base 4, or the embedded mounting base 5, is a hollow main post 6 to which has been welded a collar 7. The collar 7 contains two vertically-oriented collar holes 8, as shown more clearly in FIG. 3. The main post 6, collar 7, and bolted mounting base 4 may be constructed of any mutually compatible geometric lateral cross section. For illustrative purposes, these three components are all depicted as square in shape. The inner dimensions of the collar 7 are of greater length and width than are the outer dimensions of both the main post 6 and the bolted mounting base 4, as depicted in FIG. 4.

Again referring to FIG. 1, it is observed that the main post 6 and its welded-on collar 7 are shown placed atop the bolted mounting base 4. The main post 6 and collar 7 are secured in place by means of two collar bolts 9. Higher up the main post 6 there is attached a horizontally-oriented restrictor arm 29. The restrictor arm 29 serves as the point of contact for vehicles whose upper extremities will collide with an overhanging obstacle should the vehicle continue past the location of the height restrictor 28. The height restrictor 28 comprises a head assembly 10 and a head assembly housing 18.

Figure 5:
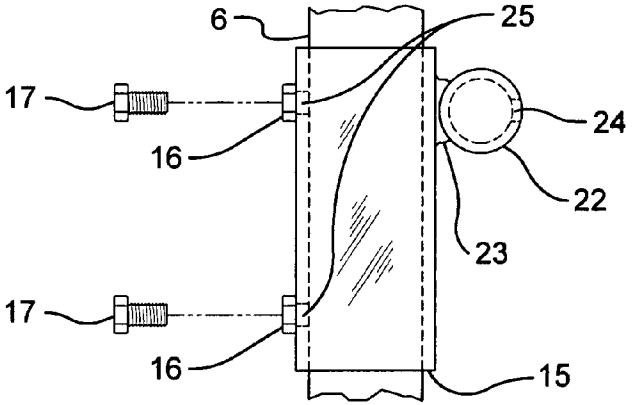
FIG. 5 is a view of the head connector and its welded-on hollow sphere.

Referring to FIG. 5, a cutaway view of the head connector 15, included a welded-on hollow metal sphere 22 is presented. In a similar manner as the design of the collar 7 dimensions, the inner dimensions of the head connector 15 are such as to allow the head connector 15 to fit comfortably over the outer dimensions of the main post 6.

Two connector holes 25, one beneath the other, are drilled into one outer wall of the head connector 15. For each connector hole 25, a connector nut 16, with a threaded hole of the same inner diameter as its paired connector hole 25, is coaxially centered with the connector hole 25 and then said connector nut 16 is welded onto the wall of the head connector 15. During final assembly of the height restrictor 28, connector bolts 17 are rotated into the connector nuts 16, through the connector holes 25, and tightly fitted against the outer wall of the main post 6. It is at this point of the assembly that the height restrictor 28 may be adjusted up or down along the length of the main post 6 to match the required alerting height of the overhead obstacle.

As further seen in FIG. 5, the hollow sphere 22 is welded 23 to the outer surface of the wall of the head connector 15 opposite the connector nuts 16. There is also depicted a circular opening 24 drilled through the hollow sphere 22 so as to allow insertion of a passing link chain 11. The passing link chain 11 is welded to the inner wall of the hollow sphere 22 as more clearly depicted in FIG. 6.

Figure 6:
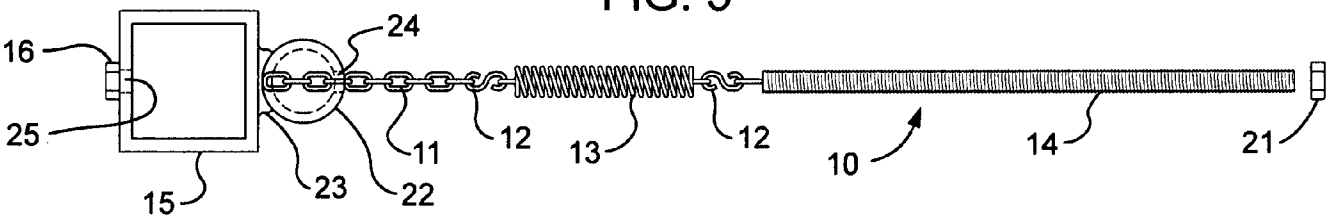
FIG. 6 displays the internal spring mechanism of the head assembly.

FIG. 6 presents a full view of the head assembly 10 which comprises the primary functional component of the inventive concept. Plan views of both a longitudinal cross-section of the head connector 15, and a view of the head assembly 10 are shown. Scanning FIG. 6 from left to right, there is observed the head connector 15, onto which is welded 23 the hollow sphere 22. Within the hollow sphere 22, at its tangential point to the head connector 15, one end of the passing link chain 11 is welded. A circular opening 24 has been drilled through the hollow sphere 22 to allow the passing link chain 11 to pass freely through and to oscillate, as necessary, in a variety of directions, as may be caused by a nudge from a vehicle. The passing link chain 11, at its distal end, connects, by means of an S-hook 12, to an extension spring 13. On the opposite end of the extension spring 13 a second S-hook 12(*a*) is engaged. The second S-hook 12(*a*) is inserted through a hole at the proximate end of an elongated threaded rod 14. At the distal end of the threaded rod 14 a retaining nut 21 is rotated into position to secure a head assembly housing 18, said housing functioning to cover the entirety of the head assembly 10.

Figure 7:
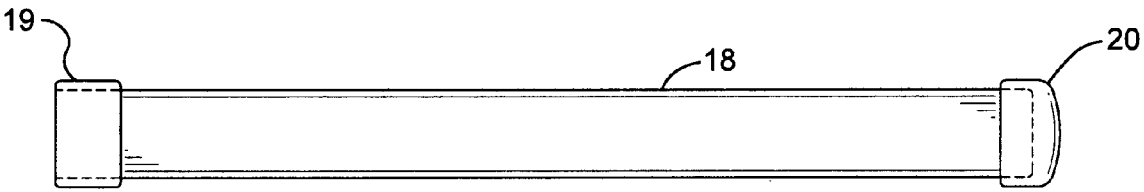
FIG. 7 shows the housing for the head assembly.
Figure 7A:
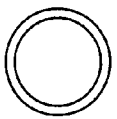

FIG. 7 depicts the head assembly housing 18, a reducer bushing 19, and a housing end cap 20. The reducer bushing 19 and the housing end cap 20 may be glued onto their respective ends of the head assembly housing 18. The specific embodiment presented in FIG. 7 and FIG. 7(*a*) shows the head assembly housing 18 as a circular tube. Other embodiments may utilize the head assembly housing 18 in a square longitudinal cross-section, or in any other geometric shaped cross-section. The housing end cap 20 contains a center-positioned hole to allow a short protrusion of the distal end of the threaded rod 14. The retaining nut 21 is then rotated onto the threaded rod 14 and securely tightened against the end cap 20.

In its operational environment, once the mounting base 4 and main post 6 of the height restrictor 28 are assembled and securely mounted at the required location, a calculation is made as to the height of the associated overhanging obstruction to which an alert is desired. The head assembly 10 and housing 18 are united with the head connector 15 by the final step of securing the retaining nut 21 against the end cap 20, thus forming the restrictor arm 29. The head connector 15 is next positioned over the perimeter of the main post 6 and positioned vertically at a linear measurement corresponding to the desired alert height. The head connector 15 is then securely fastened into place by means of head connector bolts 17 inserted through the head connector 15 and securely fastened against the main post 6.

As an over-height vehicle approaches the height restrictor 28 and contact is made with the restrictor arm 29, the extension spring 13 within the hollow sphere 22 allows the restrictor arm 29 to move forward, aft, up, or down, or any combination of these directions, as an input force is received from the vehicle. Thus, the driver, or any person positioned to observe the approach of the vehicle, is alerted to the probability of a collision with the overhanging obstruction. Once the alert is observed and the driver makes a corrective re-positioning of the vehicle, the restrictor arm 29 is pulled back to its original horizontal position by retraction of the extension spring 13 and the centering effect of the reducer bushing 19, due to the inherent seating of the reducer bushing 19 against the hollow sphere 22.

The design of the height restrictor 28 also permits the inclusion of internal wiring which may supply a low-voltage source to an aural warning system and/or an illuminated light, either on the height restrictor 28 or at a nearby manned station or checkpoint. This inventive concept may be disassembled and re-located to any suitable location, depending on the permanency of its mounting foundation.

It is recognized that one knowledgeable and skilled in the art, has the capability to design or produce similar, or other embodiments of the disclosures presented herein. However all such variations, alterations, or modifications are entirely conceivable as being within the intent and scope of the present inventive concept.

What is claimed is:

1. A vehicle height restrictor and alerting device, comprising (a) an embedded mounting base having an upper end and a lower end, wherein said lower end is firmly embedded in soil, concrete, or other substance;

(b) a longitudinal main post having an upper end and a lower end;

(c) a collar conjointly attached to the upper end of said embedded mounting base and to the lower end of said main post thereby forming a continuous vertical structure;

(d) a head connector affixed proximate the upper end of said main post said head connector having a hollow metal sphere welded to one face of said head connector;

(e) a restrictor arm comprising a head assembly housing enveloping a head assembly, said head assembly housing comprising a proximal end which culminates in a reducer bushing that rotatably fits over said hollow metal sphere;

(f) wherein said head assembly, said reducer bushing, and said hollow metal sphere allow said restrictor arm to rotate and pivot in any of a plurality of directions and orientations relative to a point proximate said head connector when said restrictor arm is subjected to a force received from a contacting vehicle.

2. A vehicle height restrictor and alerting device comprising (a) an embedded mounting base having an upper end and a lower end, wherein said lower end is firmly embedded in soil, concrete, or other substance; and further, said embedded mounting base comprises a square cross-section hollow column with a square-shaped interior;

(b) a longitudinal main post having an upper end and a lower end; and further, having a primarily longitudinal, square, cross-section hollow post;

(c) a collar conjointly attached to the upper end of said embedded mounting base and to the lower end of said main post, thereby forming a continuous vertical structure, wherein (i) said collar comprises a short, square cross-section hollow post wherein the inner dimensions of said collar allows placement of the collar over the exterior perimeter of both said embedded mounting base and said main post, whereupon said collar is welded to both said embedded mounting base and said main post; and (ii) said collar further comprises two welded-on, threaded nuts concentrically aligned with two respective holes drilled through the wall of one face of said collar thereby allowing the placement of a threaded bolt into each said hole whereupon, after placement of said main post and collar over said embedded mounting base, said bolts are securely tightened against the exterior perimeter of said main post;

(d) a head connector affixed proximate the upper end of said main post, wherein (i) said head connector comprises a short, square-shaped hollow post having a square interior cross section, the interior walls of said head connector of dimensions permitting the placement of said head connector over the outer perimeter of said main post proximate the upper end of said main post, and welded thereto; and (ii) said head connector further having a hollow metal sphere welded onto one face of said head connector and two threaded nuts symmetrically welded onto the opposite face of said head connector, said threaded nuts concentric with two respective holes penetrating the wall of said head connector;

(e) a head assembly horizontally attached to said head connector by such means as to allow said head assembly to rotate and pivot in any of a plurality of directions and orientations relative to a point proximate said head connector when said head assembly is subjected to a force; wherein said head assembly comprises, in the following sequence, a passing link chain, said passing link chain permanently affixed to the interior of said hollow metal sphere, an S-hook connected to said passing link chain, an extension spring, and an elongated threaded rod, all joined in a continuous horizontal orientation; and (f) a head assembly housing enveloping the length of said head assembly and further capable of transmitting a force, when contacted by a moving object, directly to said head assembly and said head assembly housing further comprising a cylindrical shape wherein the proximal end of said cylindrical shape culminates in a reducer bushing fitted over said metal sphere, and the distal end of said cylindrical shape culminates in a housing end cap having a centered hole of sufficient diameter to permit exposure of the distal end of said threaded rod as to allow engagement of a retaining nut snug against the exterior surface of said housing end cap.

3. A vehicle height restrictor and alerting device, comprising:

(a) a base plate having a lower surface and an upper surface, said base plate affixed in a horizontal orientation upon a supporting, surface;

(b) a short base post welded to said base plate in a vertical orientation;

(c) a longitudinal main post having an upper end and a lower end;

(d) a collar attached to the lower end of said main post and simultaneously attached to the upper end of said short base post, thereby forming a continuous vertical structure;

(e) a head connector attached to said main post proximate its upper end said head connector having a hollow metal sphere welded to one face of said head connector;

(f) a restrictor arm comprising a head assembly housing enveloping a head assembly, said head assembly housing comprising a proximal end which culminates in a reducer bushing that rotatably fits over said hollow metal sphere;

(g) wherein said head assembly, said reducer bushing, and said hollow metal sphere allow said restrictor arm to rotate and pivot in any of a plurality of directions and orientations relative to a point proximate said head connector when said restrictor arm is subjected to a force received from a contacting vehicle.

4. A vehicle height restrictor and alerting device comprising (a) a base plate having a lower surface and an upper surface, said base plate affixed in a horizontal orientation upon a supporting surface; wherein said base plate comprises a rectangular-shaped, horizontally-oriented planar device, said base plate having at least four holes symmetrically drilled around its perimeter, said holes suitable for the insertion of fastening means;

(b) a short base post welded to said base plate in a vertical orientation, wherein said short base post comprises a square-shaped hollow post having an upper end and a lower end, and further having a square-shaped perimeter;

(c) a longitudinal main post having an upper end and a lower end, wherein said main post comprises a primarily longitudinal, square-shaped hollow post, said main post being identical in cross-sectional dimensions to the cross-section of said base post, (d) a collar attached to the lower end of said main post and simultaneously attached to the upper end of said short base post, thereby forming a continuous vertical structure, said collar further comprising (i) a short, square-shaped hollow post with a square-shaped interior of such dimensions as to facilitate the interior of said collar enveloping the outer walls of the upper end of said short base post and the lower end of said main post, whereupon said collar is welded thereto, and (ii) two welded-on, threaded nuts concentrically aligned with two respective holes drilled through the wall of one face of said collar, thereby allowing the placement of a threaded bolt into each said hole whereupon, after placement of said main post and collar over said bolted mounting base, said bolts are securely tightened against said outer wall of said main post;

(e) a head connector attached to said main post proximate its upper end wherein (i) said head connector comprises a short, square-shaped hollow post having a square interior cross section, the interior walls of said head connector of dimensions permitting the placement of said head connector over the outer walls of said main post proximate the upper end of said main post, and welded thereto and (ii) said head connector further having a hollow metal sphere welded onto one face of said head connector and two threaded nuts symmetrically welded onto the opposite face of said head connector, said threaded nuts concentric with two vertically-aligned holes penetrating the wall of said head connector, (f) a head assembly attached to said head connector by such means as to allow said head assembly to rotate and pivot in any of a plurality of directions relative to a point proximate said head connector when said head assembly is subjected to a force; wherein said head assembly comprises, in the following sequence, a passing link chain, said passing link chain permanently affixed to the interior of said hollow metal sphere, an S-hook, an extension spring, and an elongated threaded rod, all joined in continuous horizontal orientation; and (g) a head assembly housing enveloping the length of said head assembly and further capable of transmitting a force, when contacted by a moving object, directly to said head assembly, and further, said head assembly housing comprises a cylindrical shape wherein the proximal end of said cylindrical shape culminates in a reducer bushing fitted over said metal sphere, and the distal end of said cylindrical shape culminates in a housing end cap having a centered hole of sufficient diameter to permit exposure of the distal end of said threaded rod as to engage a retaining nut snug against the exterior surface of said housing end cap.

5. A method for alerting and warning the driver of a vehicle of a vertically overhanging impediment in the projected path of the vehicle, comprising the steps of a) calculating the lowest height of the impediment:

b) constructing a vehicle height restrictor in the manner and with the components set forth in the following sub-steps (i) through (v)

(i) constructing an embedded mounting base having an upper end and a tower end, wherein said lower end is firmly embedded in soil, concrete, or other substance at a distance sufficiently preceding said impediment;

(ii) constructing a longitudinal main post having an upper end and a lower end;

(iii) constructing a collar and conjointly attaching said collar to the upper end of said embedded mounting base and to the lower end of said main post thereby forming a continuous vertical structure;

(iv) constructing a head connector affixed proximate the upper end of said main post, said head connector having a hollow metal sphere welded to one face of said head connector;

(v) constructing a restrictor arm comprising a head assembly housing enveloping a head assembly, said head assembly housing comprising a proximal end which culminates in a reducer bushing that rotatably fits over said hollow metal sphere;

wherein said head assembly, said reducer bushing and said hollow metal sphere allow said restrictor arm to rotate and pivot in any of a plurality of directions and orientations relative to a point proximate said head connector when said restrictor arm is subjected to a force received from a contacting vehicle; and c) adjusting the vertical height of the attachment point of said bead assembly along the length of said main post so as to coincide with the lowest height of said impediment.

* * * * *